United States Patent [19]

Schultz

[11] 4,454,806

[45] Jun. 19, 1984

[54] ABRADING MACHINE

[76] Inventor: Timothy Schultz, P.O. Box 466, Madison, S. Dak. 57042

[21] Appl. No.: 433,793

[22] Filed: Oct. 12, 1982

[51] Int. Cl.[3] ..... B02B 3/00; B02B 7/02

[52] U.S. Cl. ..... 99/609; 99/523; 99/618; 99/623

[58] Field of Search ..... 99/518–524, 99/568, 574–576, 579, 584, 586, 600, 609–611, 617–622, 623, 626, 629–633

[56] References Cited

U.S. PATENT DOCUMENTS 128,912 7/1872 Robinson ..... 99/521

294,225 2/1884 Griffiths ..... 99/521

1,503,423 7/1924 Little ..... 99/521

FOREIGN PATENT DOCUMENTS 682263 8/1979 Japan ..... 99/623

*Primary Examiner*—Timothy F. Simone

*Attorney, Agent, or Firm*—Merchant, Gould, Smith, Edell, Welter & Schmidt

[57] ABSTRACT

The present invention is a seed dehulling device including mechanism for adjusting the aggressiveness of the device. The adjusting mechanism provides for changing the spacing between an abrading disc and an adjacent plate.

11 Claims, 6 Drawing Figures

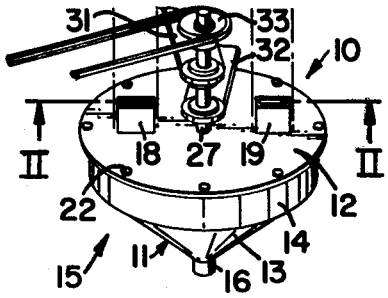
FIG. I
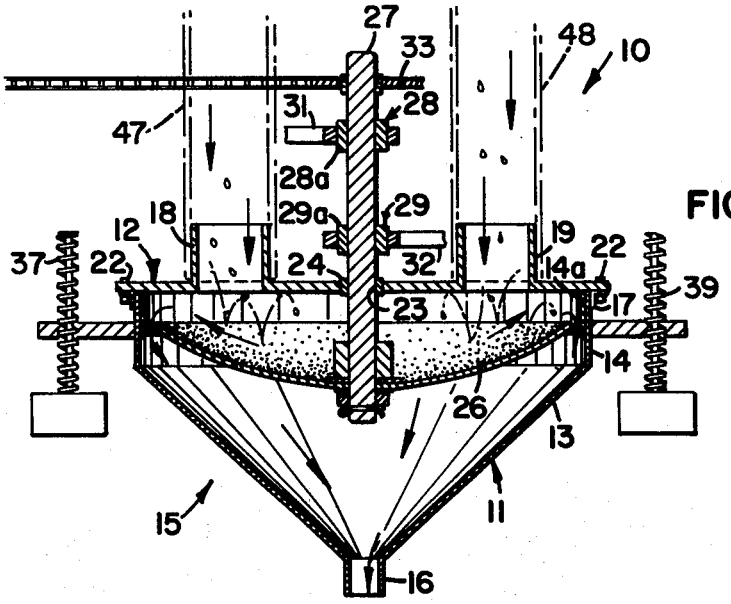
FIG. II
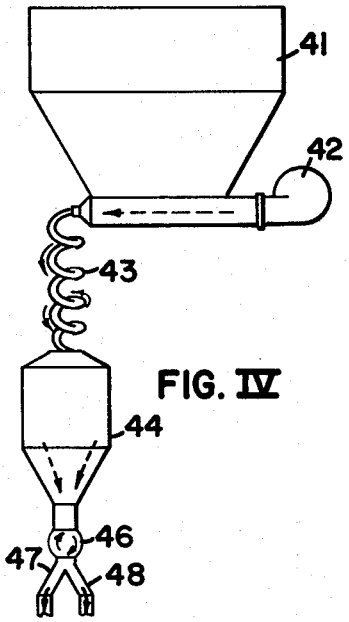
FIG. IV
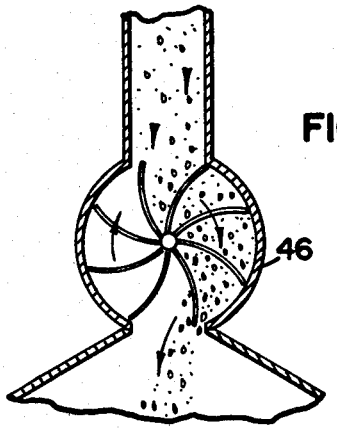
FIG. V

FIG. III
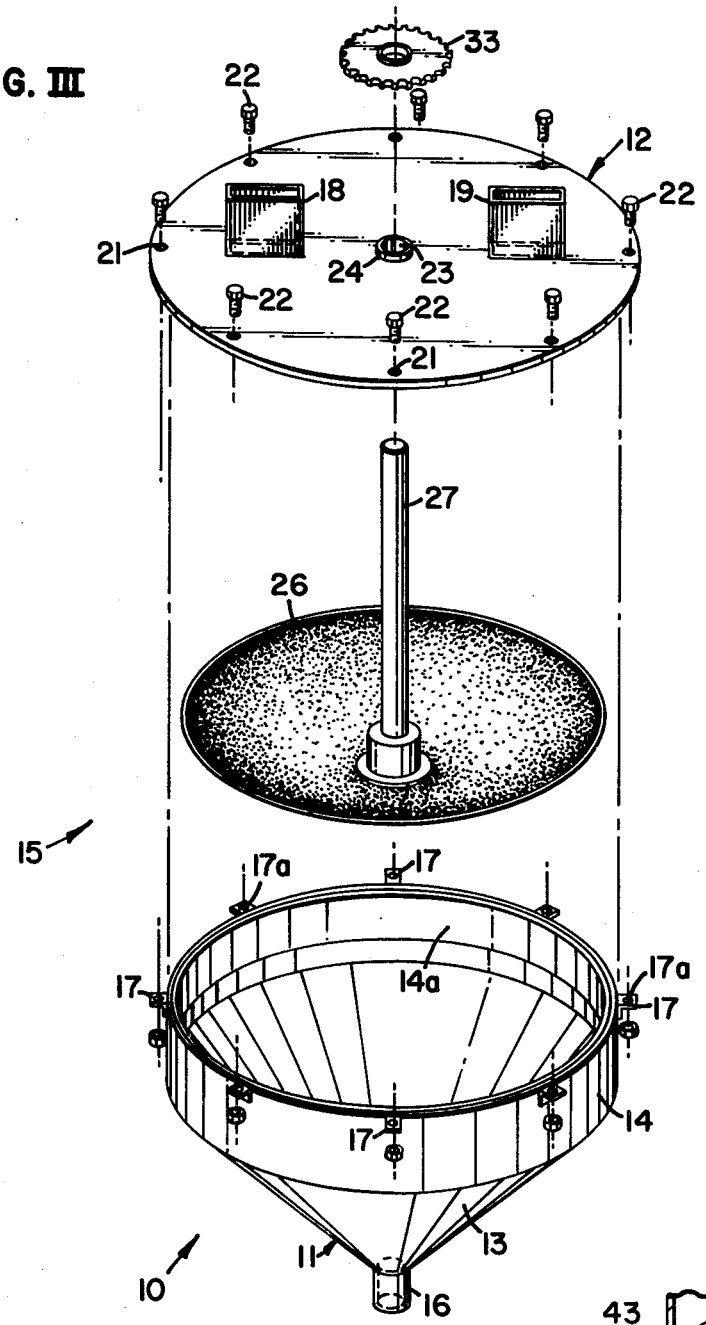
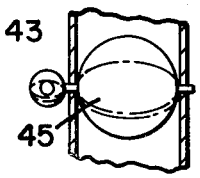
FIG. VI

ABRADING MACHINE

BACKGROUND OF THE PRESENT INVENTION

The present invention relates to apparatus for abrading seed kernels, for example to remove seed hulls and tough outer skin from seeds.

A variety of methods and apparatus have been used in the past for dehulling grain, such as oats, and the like. Most persons who have been around maturing oat in a field have stripped oat grains from the stalks and have rubbed the grains between their hands to dislodge the outer hulls. Examining the grain remaining shows a tough outer skin that must be removed if the inner portion is to be used for human consumption. The oat kernel is only illustrative of many of the grains that are used for human food such as barley, rye, and the like. A simple mechanism is desired for removing both the outer hulls as well as the tough outer skin from the grain kernels. One apparatus used for this purpose in the past is shown in U.S. Pat. No. 128,912. The grain decorticating machine there shown has a plurality of funnel shaped wheels with roughened surfaces. A first set including a plurality of such wheels are mounted for rotation on a drive shaft. A second set of such wheels are mounted to a stationary frame, thereby providing adjacent surfaces which move relative to each other. Grain is passed between the adjacent surfaces and the decorticating takes place therebetween. Various other types of such apparatus are illustrated in U.S. Pat. No. 28,117 (Turner), U.S. Pat. No. 52,774 (Van Peyma), U.S. Pat. No. 126,567 (Newman), U.S. Pat. No. 166,416 (Seck), U.S. Pat. No. 504,173 (Provost), U.S. Pat. No. 668,843 (Smith), U.S. Pat. No. 1,051,877 (GabbettFairfax).

A problem commonly encountered in the past has related to the fact that the hulls and outer skin e.g. pericarp portions of the seeds of various grains differ as to the ease of removal. In some instances, a substantial amount of working is required in order to dislodge the hulls and pericarp portions. In other instances, the hulls and pericarp are very easily removed and, if subjected to substantial working, the heart of the grain is broken up. The present invention overcomes such prior difficulties and provides apparatus which is adjustable to provide lesser or greater amounts of working of the kernels, depending on the tenacity of the hulls and pericarp. Moreover, the present apparatus further provides mechanism for loosening the hull and pericarp prior to the abrading mechanism.

SUMMARY OF THE INVENTION

The present invention relates to apparatus for dehulling or removing pericarp of grain, using a rotating concave disc carrying an abrasive coating. The disc is mounted in a stationary enclosed body. The disc is mounted for rotation with respect to the stationary body. The body includes an upper planar wall with grain inlets provided therein. The body further includes a funnel-like portion terminating at the lower end in an outlet. The body is vertically adjustable with respect to the rotatable disc to vary the spacing between the upper planar wall and the upper surface of the concave disc. The disc is supported on a shaft which is rotatably driven by power mechanism such as a gasoline engine or an electric motor.

The feeding portion of the apparatus may include a hopper for storage of a large volume of grain and a spiral-like duct leading from the storage hopper to a secondary hopper. A blower may be used to provide an airstream for rapidly carrying the grain through the spiral duct. The secondary hopper may serve to accumulate the grain and drain off the air flow. The secondary hopper may include a rotary valve which feeds into a duct or ducts leading to the aforementioned rotatable disc.

BRIEF DESCRIPTION OF THE DRAWINGS

FIG. 1 is a perspective view of the hull removing apparatus of my invention;

FIG. II is a cross-sectional view taken along the line II—II in FIG. I;

FIG. III is an exploded perspective view of the apparatus of FIG. I;

FIG. IV is a side elevational view of the hull loosening apparatus of my invention; and FIG. V shows a cross-sectional view of the valve used in the hull-loosening portion of the apparatus.

FIG. VI shows cross-sectional view of a baffle for use in the feeding portion of my invention.

DETAILED DESCRIPTION OF THE PRESENT INVENTION

The dehulling apparatus 10, one embodiment of which is shown in FIGS. I–III, includes a lower funnel-shaped member 11 and an upper plate-like member 12 which together forms a body 15. The portion 11 may have an inwardly sloped section 13 which is integral with the cylindrically shaped wall portion 14. Portion 11 may further include an outlet 16 extending downwardly from the lower end of Section 13. Section 14 may have a plurality of radially outwardly extending flanges 17 with openings **17*a* defined therein for purposes hereinafter described. The cylindrical wall portion 14 may have a resilient cushion pad 14*a* adhered to the inner surface. The resilient pad 14*a* may have a rubber foam core surrounded by a rubber sheet outer skin. Pad 14*a* serves to cushion the dehulled kernel as it is thrown laterally toward wall 14**, thereby minimizing fracturing of the kernel.

The upper plate-like member 12 may be slightly large in diameter than wall portion 14. Member 12 has a pair of inlet tubes 18 and 19 which may be interconnected to any desired grain storage facility, such as a hopper. The inlets 18 and 19 are shown to be rectangular tubes, however, such tubes may be of any desired shape. The member 12 has a plurality of openings 21 which align with opening **17*a* in each flange 17 such that bolts 22 may extend therethrough to secure member 12 to member 11**.

Member 12 has an opening 23 defined in the center thereof in which a bushing or bearing 24 may be mounted.

Dehulling apparatus 10 has a concave disc member 26 mounted on a shaft 27. Member 26 is locked with respect to shaft 27. Disc member 26 may be of metal or of a suitable polymeric material. As illustrated in FIG. II, shaft 27 extends through bushing 24. Shaft 27 is rotatable in bushing 24. The shaft 27 may be suitably supported by a pair of pillar block and bearing combinations 28, 29. The bearing portions **28*a* and 29*a* may be mounted in suitable support arms 31, 32. The shaft 27 has a sprocket 33 mounted adjacent the upper end thereof for drive by any suitable power source, such as an electrically powered motor. The sprocket 33 is, of course, locked to shaft 27**.

Body 15 is supported by vertically adjustable mechanism such as screw jacks 37, 39. Elevation of portion 11 by screws 37, 39 provides for increasing the space between member 12 and the upper surface of concave disc 26, whereas lowering of member 11 reduces such spacing.

Disc 26 desirably is concave, as illustrated in FIG. II. However, in some applications it may be desirable to provide disc 26 in a substantially flat configuration rather than concave. The upper surface of disc 26 is roughened, for example, by imbedding abrasive particles in the polymeric substrate or by securing the abrasive particles to a metallic substrate using an adhesive. The abrasive particles may be silicon carbide or zinc oxide. The abrasive such as number 46 abrasive.

Operation of the dehulling apparatus 10 is quite simple. Apparatus 10 is placed in operation by rotatably driving sprocket 33 to rotate shaft 27 and disc 26, while member 11 remains stationary. Grain kernels are fed to inlets 18 and 19 at a controlled rate so as not to overload the equipment. The kernels fall to strike the abrasive upper surface of disc 26. As the kernel strikes such surface, it rebounds and strikes the plate member 12, again rebounding to strike disc 26. Such rebounding is repeated many times until the dehulled kernel moves around the periphery of disc 26 and falls downwardly in member 11. The amount of working of the kernel between disc 26 and plate member 12 may be adjusted by controlling the spacing between plate 12 and disc 26. The closer the spacing, the greater the working of the kernels therebetween. The working is further controlled to a degree by the rotational rate of the disc 26. It has been found desirable, for example, to rotate disc 26 at about 900 to 1400 rpms. One preferred embodiment included a disc 26 having a 22 inch diameter. The outer leading edge of the disc may be traveling in the range of 85 to 135 feet per second.

Although any of the wide variety of feeding mechanisms may be used in the present dehulling apparatus, one type of feed mechanism is illustrated in FIGS. IV and V. Hopper 41 feeds grain to a blower 42 which rapidly drives the grain kernels through the cyclonic tubing 43. The tubing 43 desirably has an inner surface which is roughened to assist in the early loosening of the hull of the grain kernel. If desired, additional disruptive forces may be created in the cyclonic tube 43, such as by use of adjustable baffles 45 (FIG. VI) and the like mounted within the tube. The grain kernels then fall into a secondary hopper 44 where the air currents are drawn off, such as through a filter, and the kernels are fed downwardly through a rotary valve 46. Valve 46 desirably prevents the air currents from entering into the dehulling portion of the present apparatus. The rotary valve 46 may feed to a pair of ducts 47, 48 which are, in turn, connected to inlets 18 and 19 of apparatus 10. The ducts 47, 48 may be of any suitable construction which will permit vertical movement of the dehuller 10 for example flexible tubing.

Although specific embodiments are disclosed herein, it is to be recognized that a variety of modifications may be made without departing from the broader scope of the present invention. For example, a preferred feeding section 40 is disclosed. It is to be recognized that other feeding mechanism may be provided. For example, the feeding section may be merely a simple stepped elevator feeding into a conventional hopper.

What is claimed is:

1. A seed dehulling device comprising:

body means defining a cavity, said body means including lower wall means for collecting dehulled seed, said lower wall means including an outlet, said body means further including an upper wall means overlying said lower wall means, said upper wall means including seed inlet means;

means for supporting said body means;

means for feeding seed to said seed inlet means;

a rotatably driven disc disposed in said cavity, said disc having an upwardly facing abrading surface, said surface being spaced downwardly from said upper wall means;

means for rotatably driving said disc; and means for adjusting the spacing between said upper wall means and the abrading surface of said disc, said adjusting means comprising means for elevating and lowering said body means, whereby said spacing is sufficient to provide repeated rebounding of seed kernels between said disc and said upper wall means, and whereby said adjusting means provides control of the amount of working of said seed kernels.

2. The seed dehulling device of claim 1 wherein said abrading surface is a concave surface.

3. The seed dehulling device of claim 1 wherein said rotatably driven disc comprises an upwardly facing disc mounted on a vertically oriented drive shaft, said disc and shaft being rotatably driven and vertically stationary.

4. The seed dehulling device of claim 1 wherein said seed feeding means comprise pneumatic duct means defining a tortuous path, said feeding means serving to loosen the hull of said seeds.

5. The seed dehulling device of claim 4 wherein said duct means comprises a spiral duct having an internal rough abrading surface.

6. The seed dehulling device of claim 5 wherein said duct means include baffle means for disturbing the flow through said duct means.

7. The seed dehulling device of claim 5 wherein said duct means include adjustable baffle means to direct seed against said rough abrading surface.

8. The seed dehulling device of claim 1 wherein said device includes means for rotatably driving said disc at a tip speed in the range of 85 to 135 feet per second.

9. The seed dehulling device of claim 8 wherein said abrading surface comprises abrading particles adhered to the upper surface of said disc.

10. The seed dehulling device of claim 9 wherein said abrading particles are of a member 46 grit size.

11. The seed dehulling device of claim 8 wherein said lower wall means includes cushion pad means for minimizing fracturing of dehulled kernnels.

* * * * *